US007067068B2

(12) United States Patent
Sanuki et al.

(10) Patent No.: US 7,067,068 B2
(45) Date of Patent: Jun. 27, 2006

(54) METHOD FOR PREVENTING LEAD FROM DISSOLVING FROM A LEAD-CONTAINING COPPER-BASED ALLOY

(75) Inventors: Sumiko Sanuki, Toyama (JP); Kunio Nakashima, Tateyama-machi (JP); Ryouichi Ishigane, Tateyama-machi (JP); Wataru Yago, Tateyama-machi (JP); Kenichi Ichida, Tateyama-machi (JP); Atsushi Yasukawa, Tateyama-machi (JP); Kazuo Takeuchi, Tateyama-machi (JP)

(73) Assignee: Chuetsu Metal Works Co., Ltd. (JP)

( * ) Notice: Subject to any disclaimer, the term of this patent is extended or adjusted under 35 U.S.C. 154(b) by 349 days.

(21) Appl. No.: 10/242,952

(22) Filed: Sep. 13, 2002

(65) Prior Publication Data

US 2003/0136764 A1 Jul. 24, 2003

(30) Foreign Application Priority Data

Sep. 14, 2001 (JP) ..... 2001-280219

(51) Int. Cl.
*C23F 1/00* (2006.01)

(52) U.S. Cl. ..... 216/93; 216/105; 216/106

(58) Field of Classification Search ..... 216/83, 216/93, 100, 105, 106
See application file for complete search history.

(56) References Cited

U.S. PATENT DOCUMENTS 4,352,786 A * 10/1982 Hoh et al. ..... 423/98
4,704,260 A * 11/1987 Shugarman ..... 423/92
5,454,876 A 10/1995 Downey
5,601,658 A * 2/1997 Marinas et al. ..... 134/3
5,660,806 A * 8/1997 Fristad et al. ..... 423/98
5,707,421 A 1/1998 Joe
5,904,783 A 5/1999 Hager et al.
6,197,210 B1 3/2001 Myerson
6,270,590 B1 8/2001 Giusti
6,432,210 B1 8/2002 Cote et al.
6,447,616 B1 9/2002 Cote et al.

FOREIGN PATENT DOCUMENTS

JP H10-72683 3/1998

* cited by examiner

*Primary Examiner*—Nadine G. Norton
*Assistant Examiner*—Binh X. Tran
(74) *Attorney, Agent, or Firm*—Thompson Hine LLP

(57) ABSTRACT

A lead-containing copper-based alloy is immersed into a weak acidic or neutral etching solution having a buffer effect which is formed by adding an organic acid into a complexing agent having a high ability to form a complexing ion with lead, and lead particles present on the surface of the lead-containing copper-based alloy are then removed. The complexing agent is one of an organic ammonium salt such as ammonium acetate, or ammonium citrate, or may be an organic sodium salt such as sodium acetate, sodium tartrate, and sodium citrate. Preferably, an immersion temperature of the alloy to the etching solution falls within a range of from 10 to 50° C. The etching solution is agitated with oxygen or a gas containing oxygen blown thereinto during the immersion of the alloy into the etching solution. An extremely low voltage of −0.3 to +0.2 V vs. NHE is applied from outside to the lead-containing copper-based alloy as an anode.

15 Claims, 1 Drawing Sheet

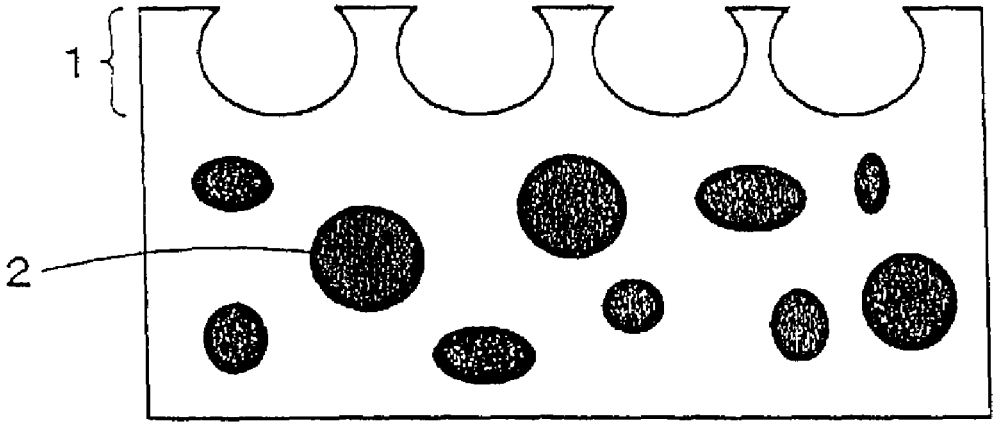
1
2

METHOD FOR PREVENTING LEAD FROM DISSOLVING FROM A LEAD-CONTAINING COPPER-BASED ALLOY

CROSS REFERENCE TO RELATED APPLICATION

This application claims priority from Japanese patent application 2001-280219 filed Sep. 14, 2001.

BACKGROUND OF THE INVENTION

1. Field of the Invention

The present invention relates to a method for effectively preventing lead in a lead-containing copper-based alloy from dissolving, which is conventionally used in a faucet.

2. Description of the Related Art

Copper-based alloys such as bronze are currently used for the faucet. Lead is added to the materials of the faucet to improve machinability, ease of casting, and pressure resistance. Lead is distributed in the form of particles in the alloy. Lead is, however, hazardous to humans. When lead contained bronze is used for the faucet, lead particles are dissolved into tap water from the surface of the faucet in contact with the tap water. If the tap water is used as drinking water, lead may build up in the body of human, and may adversely affect the human body. For this reason, the use of lead-free alloys for the faucet is preferred.

However, lead-free copper-based alloys with a low melting point material such as bismuth substituted for lead become costly. Lead-free copper-based alloys without low melting point material result in low machinability. It is currently difficult to produce a lead-free alloy which could satisfy both cost and performance requirements like the conventional faucet alloy containing lead.

Contemplated as means to satisfy both cost and performance requirements is a method for preventing lead in a lead-containing copper-based alloy from dissolving. A technique disclosed in Japanese Open Gazette No. 10-72683 is known.

The disclosed technique uses a strong basic sodium salt such as sodium hydroxide (NaOH) or trisodium phosphate ($Na_3PO_4$) to dissolve the lead particles on the surface of the alloy, and the strong basic sodium salt must be handled with the utmost attention. After the process, the strong basic sodium salt must be neutralized. A process bath and tools used in the process must be fabricated of a material that exhibits dissolve resistance to the strong base.

In the disclosed technique, the solution temperature must be kept to be as high as 60 to 95° C. Vapor of the strong base is hazardous to humans and the building, and thus a series of steps needs to be performed in a closed system. Particularly when etching solution containing lead subsequent to the process is disposed or recycled, adverse effect on the humans and the environment is unavoidable because the etching solution is a strong base.

SUMMARY OF THE INVENTION

Accordingly, it is an object of the present invention to provide a method which prevents lead in a lead-containing copper-based alloy from being dissolved, thereby avoiding adverse effect on the humans and the environment.

To achieve the above object, the present invention uses one of an organic ammonium salt and an organic sodium salt, each being a complexing agent having a high ability to form a complexing ion with lead, and a weak acidic or neutral etching solution containing an organic acid. More specifically, the lead-containing copper-based alloy is immersed into a weak acidic or neutral etching solution having a buffer effect which is formed by adding an organic acid into a complexing agent having a high ability to form a complexing ion with lead, and lead particles present on the surface of the lead-containing copper-based alloy are then removed. The complexing agent may be one of organic ammonium salts such as ammonium acetate, or ammonium citrate, or may be the one that is produced by adding an organic acid to each of the solutions of sodium acetate, sodium tartrate, and sodium citrate. Preferably, an immersion temperature of the alloy to the etching solution falls within a range of from 10 to 50° C.

Preferably, the etching solution is agitated with oxygen or a gas containing oxygen blown thereinto during the immersion of the alloy into the etching solution to expedite the dissolution of lead.

Preferably, an extremely low voltage of −0.3 to +0.2 V vs. Normal Hydrogen Electrode (NHE) is applied from outside to the lead-containing copper-based alloy as an anode. In this way, the surface of the alloy is subjected to electrolytic polishing in the process.

A carbon dioxide gas or a gas containing the carbon dioxide gas may be blown into the etching solution which has been used in one of the above-referenced methods, or carbonate, having solubility higher than that of lead carbonate, may be introduced into the etching solution which has been used in one of the above-referenced methods, and then dissolved lead is caused to react with carbonation having dissolve resistance so that the resulting carbonate precipitates, and the carbonate with lead is then removed. The etching solution is thus recycled.

BRIEF DESCRIPTION OF THE DRAWING

The FIGURE diagrammatically illustrates the surface of a material from which lead particles are selectively removed in accordance with the method of the present invention.

DESCRIPTION OF THE PREFERRED EMBODIMENTS

The embodiment of the present invention will now be discussed. The FIGURE diagrammatically illustrates the surface of a material from which lead particles are dissolved using a weak acidic or neutral etching solution having a buffer effect. The etching solution is produced by adding an organic acid to one of the solutions of an organic ammonium salt and an organic sodium salt, each being a complexing agent having a high ability to form a complexing ion with lead. In accordance with this method, the lead particles 2 are removed from the surface of a lead-containing alloy, and the surface of the member in contact with water becomes lead-free, thereby forming a substrate 1 of a copper-based alloy. Further dissolution of lead is thus prevented.

Table 1 lists the examples of an organic ammonium salt and an organic sodium salt, which is a complexing agent with lead and is contained in the neutral or weak acid etching solutioning solution used in the present invention.

TABLE 1

| No. | Complexing agent (compositions of etching solutioning solution) | | Chemical formula |
|---|---|---|---|
| 1 | Ammonium acetate + acetic acid | Ammonium salts | $CH_3COONH_4$ |
| 2 | Ammonium citrate + citric acid | | $C_3H_4OH(COONH_4)_3$ |
| 3 | Sodium acetate + acetic acid | Sodium salts | $CH_3COONa$ |
| 4 | Sodium tartrate + tartaric acid | | $(CHOHCOONa)_2$ |
| 5 | Sodium citrate + citric acid | | $C_3H_4OH(COONa)_3$ |

In Table 1, each organic acid is adjusted to have a mol concentration of organic acid ions of 0.05 to 1 mol/L. Immersion temperature preferably falls within a range of from 10 to 50° C.

During immersion, a gas such as air containing oxygen or oxygen itself is blown into the etching solutioning solution to feed oxygen to a reaction surface between the lead-containing alloy and the etching solutioning solution and to increase a diffusion speed of the components on the reaction surface, while the etching solution is being agitated at the same time. In this way, dissolved lead is prevented from sticking to the reaction surface in the form of lead hydroxide or basic lead carbonate.

The single electrode potential (at which a metal starts being dissolved into the etching solution) when the lead-containing copper-alloy is immersed into the etching solution containing the complexing agent listed in Table 1 is different between the base material and the lead particles. The lead particles (−0.35 V vs. NHE) dissolve at a lower voltage than that of the base material (+0.25 V vs. NHE). This is taken advantage of to promote the dissolution of lead particles from the surface of the lead-containing copper-based alloy and to increase the dissolution rate of the lead particles. During immersion, the lead-containing copper-based alloy is set to be an anode and a voltage higher than the single electrode potential of lead but lower than the single electrode potential of the base material (namely, within a range of from −0.3 to +0.2 V vs. NHE) is applied from outside. In this way, the effect on the base material is minimized, while the dissolution of the lead particles is selectively promoted. The immersion time of the lead-containing copper-based alloy is reduced to about one-sixth an immersion time of 30 minutes when no voltage is applied. The process surface of the lead-containing copper-based alloy is subjected to some degree of electrolytic polishing with the application of the voltage. The surface smoothness of the alloy is improved.

To recycle the etching solution subsequent to the lead dissolution process, a carbon dioxide gas or a gas containing the carbon dioxide gas is blown into the used etching solution, or carbonate (such as sodium carbonate, ammonium carbonate, or potassium carbonate) having solubility higher than that of lead carbonate is introduced into the used etching solution. Lead dissolved in the used etching solution is thus combined with the carbon dioxide (carbonate ions), thereby becoming lead carbonate having dissolve resistance, and being precipitated. Lead is thus easily removed as a compound.

The etching solution is subjected to a filtering process to separate the precipitated compound. To remove a slight amount of carbon dioxide dissolved in the etching solution is then subjected to an air bubbling process (to be exposed to air). Since the etching solution becomes a weak acid because of the addition of the organic acid for the adjustment of mol concentration, the air bubbling process easily removes carbon dioxide from the etching solution, and the etching solution is thus recovered for recycling under the state substantially identical to that prior to the process.

The invention is illustrated in more detail in the following non-limiting examples.

EXAMPLES

The dissolution prevention process of lead was tested using a square test piece (35×25×5t) of bronze used as a faucet and standardized in Japanese Industrial Standards JIS (Japanese Industrial Standard) H 5121 CAC406C (BC6C). Table 2 lists compositions of the test piece. The unit of chemical compositions is weight percent.

TABLE 2

| | Main compositions | | | | Other compositions | | | | | |
|---|---|---|---|---|---|---|---|---|---|---|
| | Cu | Sn | Pb | Zn | Fe | Sb | Ni | P | Al | Si |
| Test Piece | 84.52 | 4.35 | 5.12 | 5.64 | 0.045 | 0.06 | 0.19 | 0.08 | <0.005 | <0.005 |
| CAC406C | 83.0~87.0 | 4.0~6.0 | 4.0~6.0 | 4.0~6.0 | Max. 0.3 | Max. 0.2 | Max. 1.0 | Max. 0.5 | Max. 0.01 | Max 0.01 |

Table 3 lists concentrations and etching conditions of etching solution used in the test.

TABLE 3

| | Example 1 | Example 2 | Example 3 |
|---|---|---|---|
| Solution composition | Ammonium acetate 0.4 mol/L + acetic acid 0.1 mol/L (total of acetic acid ions 0.5 mol/L) | | |
| Solution temperature | 35 C | | |
| Air blown | No air blown | Air blown | |
| Voltage applied | No voltage applied | | 0.05 V vs. NHE |
| Immersion time | 45 minutes | 30 minutes | 5 minutes |

Subsequent to the test, the process surface of the test piece was observed using an X-ray Micro Analyzer (XMA) to examine the presence of residual lead and re-sticking of lead compounds to the process surface. Table 4 lists the results.

TABLE 4

| | Presence of residual lead on surface of copper-based alloy | Sticking of lead compound to surface of copper-based alloy |
|---|---|---|
| Prior to process | Yes | – |
| Example 1 | No | No |
| Example 2 | No | No |
| Example 3 | No | No |

In this way, neither residual lead on the surface of the copper-based alloy nor re-sticking of the lead compounds to the surface of the copper-based alloy was observed.

To verify that the etching solution is effectively used, a recycling test was carried out. Carbon dioxide was blown into the used etching solution and white precipitated compounds were filtered out. A dissolution prevention process was then performed again using a solution subsequent to the filtering operation under the same condition of example 3. Similarly, the processed test piece was observed using the X-ray Micro Analyzer. The observation showed that all lead particles were removed from the surface of the lead-containing copper-based alloy, and no re-sticking of the lead compounds was found. This showed that the used etching solution was recyclable.

The present invention thus provides a material for the faucet with no cost increase and exhibiting sufficient performance. By performing the surface treatment on the conventionally used lead-containing copper-based alloy, the lead particles are selectively removed from the surface thereof. The conventional alloy is thus used as is. The manufacturing method of the alloy partly uses the conventional method. Without substantially changing the manufacturing conditions of the alloy, an effective material is provided.

Since the material may be supplied with the voltage in the manufacturing process, the electrolytic polishing effect may be obtained. The surface smoothness of the material is thus improved.

The mixed gas containing carbon dioxide or carbon dioxide itself is blown into the used etching solution, or carbonate having solubility higher than that of lead carbonate is introduced into the used etching solution. Lead is thus precipitated as carbonate having dissolve resistance. This arrangement allows the lead compounds to be separated and recovered. The lead compounds are thus easily disposed while the etching solution is recyclable.

The present invention is mainly intended to be used for the material of the faucet which requires urgent handling. The present invention is not limited to this application and, of course, may be applied to various applications which need the selective removal of lead particles from the surface of a lead-containing copper-based alloy.

What is claimed is:

1. A method for preventing lead in a lead-containing copper-based alloy from dissolving, comprising the steps of:

immersing the lead-containing copper-based alloy into a weak acidic or neutral etching solution having a buffer effect which is formed by adding an organic acid into a complexing agent selected from the group consisting of an organic ammonium salt and an organic sodium salt, applying an extremely low voltage of −0.3 to +0.2 V vs. NHE (Normal Hydrogen Electrode) from outside to the lead-containing copper-based alloy as an anode; and removing lead particles present on the surface of the lead-containing copper-based alloy.

2. A method for preventing lead in a lead-containing copper-based alloy from dissolving according to claim 1, wherein the organic ammonium salt is one of ammonium acetate and ammonium citrate.

3. A method for preventing lead in a lead-containing copper-based alloy from dissolving according to claim 1, wherein the organic sodium salt is a sodium salt selected from the group consisting of sodium acetate, sodium tartrate, and sodium citrate.

4. A method for preventing lead in a lead-containing copper-based alloy from dissolving according to claim 1, wherein an immersion temperature of the alloy to the etching solution falls within a range of from 10 to 50° C.

5. A method for preventing lead in a lead-containing copper-based alloy from dissolving according to claim 1, wherein the etching solution is agitated with oxygen or a gas containing oxygen blown thereinto during the immersion of the alloy into the etching solution.

6. A method of treating a lead-containing copper-based alloy comprising the steps of:

immersing the lead-containing copper-based alloy into a weak acidic or neutral etching solution, the etching solution being formed by adding an organic acid into a complexing agent capable of forming a complexing agent with lead;

removing lead particles present on the surface of the lead-containing copper based alloy; and recycling the etching solution containing the removed lead by precipitating the lead as lead carbonate and removing the lead carbonate.

7. The method of claim 6 wherein the lead is precipitated as lead carbonate by introducing a carbon dioxide gas or a gas containing carbon dioxide gas into the etching solution.

8. The method of claim 6 wherein an immersion temperature of the alloy to the etching solution falls within a range of from 10 to 50° C.

9. The method of claim 6 wherein the etching solution is agitated with oxygen or a gas containing oxygen blown thereinto during the immersion of the alloy into the etching solution.

10. The method of claim 6 wherein a voltage of from −0.3 to +0.2 V vs. NHE (Normal Hydrogen Electrode) is applied from outside to the lead-containing copper-based alloy as an anode.

11. The method of claim 6 wherein the lead is precipitated as lead carbonate by introducing a carbonate having solubility higher than that of lead carbonate into the etching solution.

12. The method of claim 11 wherein said carbonate having solubility higher than that of lead carbonate is selected from the group consisting of sodium carbonate, ammonium carbonate, and potassium carbonate.

13. The method of claim 6 wherein the complexing agent is selected from the group consisting of an organic ammonium salt and an organic sodium salt.

14. The method of claim 13 wherein the organic ammonium salt is selected from the group consisting of ammonium acetate and ammonium citrate.

15. The method of 13 wherein the organic sodium salt is a sodium salt selected from the group consisting of sodium acetate, sodium tartrate, and sodium citrate.

* * * * *

UNITED STATES PATENT AND TRADEMARK OFFICE

CERTIFICATE OF CORRECTION

PATENT NO. : 7,067,068 B2
APPLICATION NO. : 10/242952
DATED : June 27, 2006
INVENTOR(S) : Sumiko Sanuki et al.

It is certified that error appears in the above-identified patent and that said Letters Patent is hereby corrected as shown below:

Col. 8

Line 1 - Insert --claim -- before "13".

Signed and Sealed this

Thirty-first Day of October, 2006

JON W. DUDAS
*Director of the United States Patent and Trademark Office*